US007464612B2

(12) United States Patent
Manella et al.

(10) Patent No.: US 7,464,612 B2
(45) Date of Patent: Dec. 16, 2008

(54) IMPULSE ENERGY TUBING AND CASING MAKE-UP METHOD AND APPARATUS

(76) Inventors: Eugene J. Manella, 7610 Pecan Lake Cir., Richmond, TX (US) 77469; Gregory K. Otten, 8607 Prelude Ct., Houston, TX (US) 77040

( * ) Notice: Subject to any disclaimer, the term of this patent is extended or adjusted under 35 U.S.C. 154(b) by 0 days.

(21) Appl. No.: 11/447,438

(22) Filed: Jun. 6, 2006

(65) Prior Publication Data

US 2007/0295108 A1 Dec. 27, 2007

(51) Int. Cl.
*G01L 5/24* (2006.01)

(52) U.S. Cl. ..... 73/862.25; 73/862.21; 73/862.25; 173/180; 173/181

(58) Field of Classification Search . 73/862.21–862.25; 29/240, 407.02, 714, 721, 722; 173/180, 173/181

See application file for complete search history.

(56) References Cited

U.S. PATENT DOCUMENTS 4,402,052 A * 8/1983 Stone et al. ..... 700/159
4,592,125 A * 6/1986 Skene ..... 29/407.03
5,361,852 A * 11/1994 Inoue et al. ..... 173/176
6,212,763 B1 * 4/2001 Newman ..... 29/702
6,385,837 B1 * 5/2002 Murakami et al. ..... 29/407.02
6,532,648 B2 * 3/2003 Murakami et al. ..... 29/714
6,758,095 B2 * 7/2004 Newman ..... 73/700
7,100,698 B2 * 9/2006 Kracik et al. ..... 166/380

* cited by examiner

*Primary Examiner*—Edward Lefkowitz
*Assistant Examiner*—Freddie Kirkland, III
(74) *Attorney, Agent, or Firm*—Robert C. Strawbrich

(57) ABSTRACT

A make-up assembly and process provides a true power-tight connection between a first and second tubular segment. Each of the segments has an externally threaded male member at one end and an internally threaded female member at the other end. The male member of the first segment is inserted into the female member of the second segment. A primary torque component is applied to the first segment to engage the external threads of the first segment with the internal threads of the second segment and to advance the male member of the first segment into the female member of the second segment. The value of the primary torque component is monitored. An impulse energy component is then superimposed on the primary torque component when a predetermined onset threshold has been reached. Application of one or both of the primary and impulse energy components is discontinued when a predetermined maximum threshold has been reached.

32 Claims, 12 Drawing Sheets

IMPULSE ENERGY TUBING AND CASING MAKE-UP METHOD AND APPARATUS

BACKGROUND

As oil and gas wells are drilled, segments or "joints" of pipe are threadably secured to one another (a process sometimes referred to as connection "make-up") using hydraulically or pneumatically driven equipment known as tongs to create a string of such segments known as a casing string. During this make-up process, the lower joint (i.e. the last segment of the string to be attached) is gripped in a rotary table by slips and held in place. The tongs are then typically applied above the connection to the outer surface of the next segment to be connected to the string. The upper joint is then turned by the tong until makeup is considered completed. As each segment of the string is secured, the string is successively lowered into the well-bore created by the drilling process. Additionally, production strings are also made up one segment at a time and in the same manner as described above for casing strings. Production strings are typically of a smaller outside diameter (OD) than the casing strings and are deployed within the casing strings. A production string is the tubular member through which the target fluid is produced, and is protected by the casing string.

Oil and gas wells typically consist of several casing and tubing strings telescoping from large OD (outside diameter) casing to small OD tubing. Each successive string is run after the previous string is set, cemented, pressure tested and the next section of hole is drilled ahead. It is critically important that the connection established between each pair of joints of a casing or production string is secure and remains so for the producing life of the well.

Those of skill in the art will be familiar with various tongs that are manufactured and deployed in the field for the purpose described above. For example, a hydraulic tong known as the 14-100 Hydraulic Tong is manufactured by Weatherford International Ltd. Information regarding this tong can be found on their web site at www.weathorford.com. Other tong systems, including tong computer control systems, are manufactured by Eckel Manufacturing Company, Inc. Information regarding their tongs and tong torque controllers are also available at their web site located at www.eckel.com.

The demand for oil and gas continues to increase against ever-shrinking and less easily accessed reserves. This, and the associated increase in oil prices, has motivated the drilling of wells in ever more demanding environments, exploring for and accessing formations that are increasingly more difficult to reach. For example, gaining access to many formations requires directional and even horizontal drilling that may involve abrupt changes in direction (referred to as "doglegs"). As another example, deep water drilling is often performed today in water depths of 8,000 to 10,000 ft., with the depth of such wells commonly reaching 25,000 to 35,000 ft.

Increasingly, the service conditions created by these less than ideal environments have led to near or actual failure of tubular connections in both casing and producing strings. Recently, several end-users have had connections back out (or unscrew) down-hole or have pulled strings from the bore and have found surprisingly low connection breakout torques. Breakout torque is the amount of torque required to overcome friction between the threads to unscrew the segments of pipe. In some instances, measured breakout torque of segment connections has been as low as 30% of the original makeup torque for the connections. Makeup torque is the amount of torque that must be applied to overcome the friction in the threads to complete the connection. Connection performance is highly dependent upon proper assembly, and applied and "retained" torque are key factors in promoting resistance under all service loading conditions (e.g. axial, pressure, bending, etc.) and breakout resistance. Loss of torque in the connection adversely affects pressure resistance of connections. Retained torque is the amount of the total applied torque during the make-up process that remains after the connection is made.

Recent discovery of low breakout torque in casing and production string connections has alarmed the industry sufficiently to initiate testing and investigation into alternate connection makeup procedures. Connection designers and manufacturers have also begun studies into thread compounds, surface finishes and makeup procedures. All of these efforts have attempted to achieve the common objective of ensuring that makeup torque and axial preload for each connection are retained during the entire service life of these tubular connections. While this problem has spurred much innovation in the areas of connections, threads, surface treatments, thread lubricants (compounds) and torque vs. turn equipment and software, surprisingly little innovation has taken place concerning the very basic process of connection make-up, i.e. screwing the two members together.

BRIEF DESCRIPTION OF THE DRAWINGS

For a detailed description of embodiments of the invention, reference will now be made to the accompanying drawings in which.

NOTATION AND NOMENCLATURE

Figure 1:
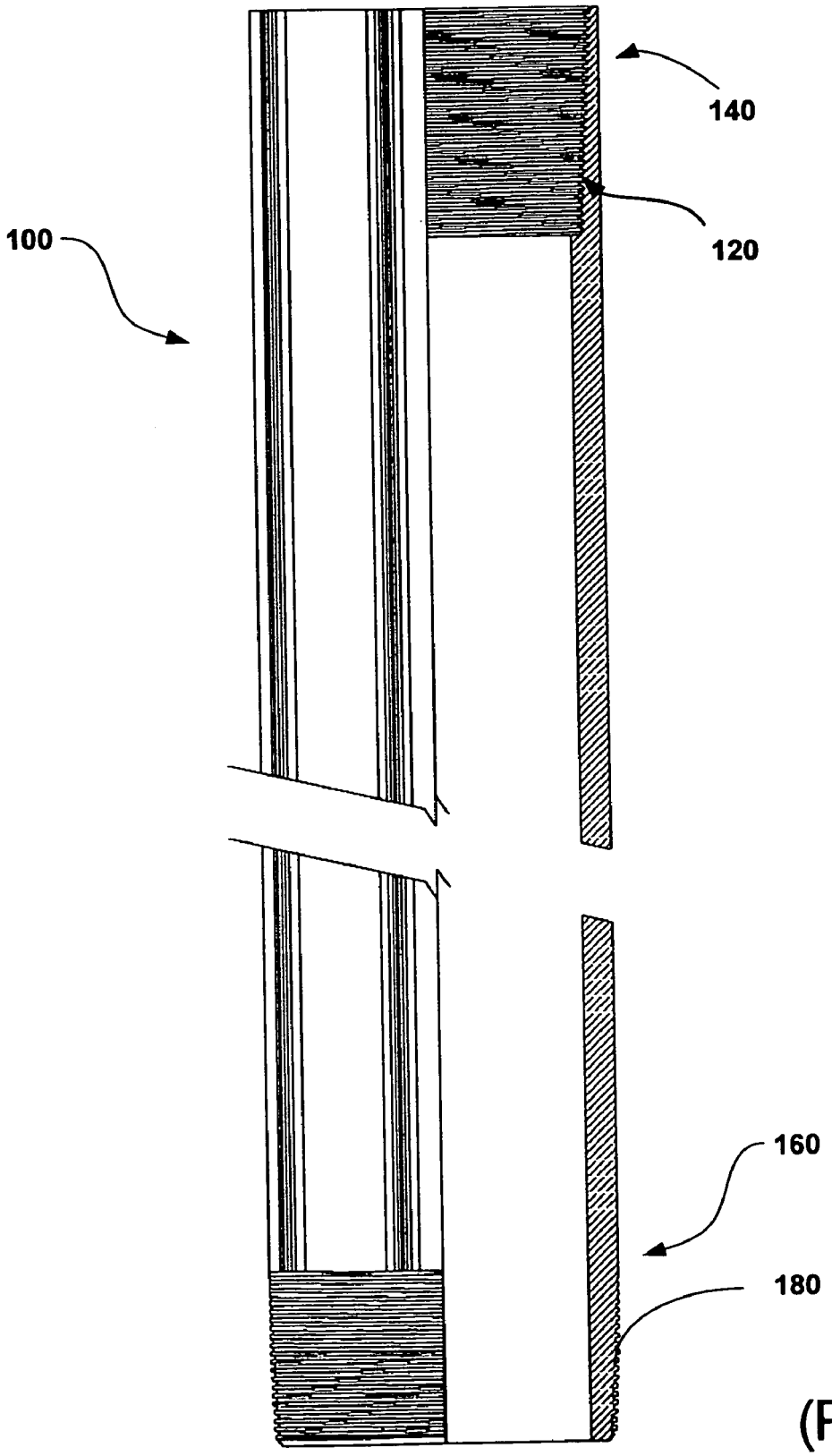
Fig. 1 (Prior Art)
FIG. 1 is an illustration of a type of tubular segment that has female and male members threaded on its opposite ends such that when two of these segments are screwed together, they form a connection known in the art as an integral joint connection.

Certain terms are used throughout the following description and in the claims to refer to particular features, apparatus, procedures, processes and actions resulting therefrom. Those skilled in the art may refer to an apparatus, procedure, process, result or a feature thereof by different names. This document does not intend to distinguish between components, procedures or results that differ in name but not function. For example, the imposition of an impulse energy component is intended to mean any energy perturbations that are introduced into the connection thread interface in addition to the torque conventionally applied in prior art make-up processes. These energy perturbations are typically repetitive and of short duration relative to the torque conventionally applied in prior art make-up processes. These impulse energy components may be applied directly as a secondary torque component superimposed over the conventionally applied torque and imposed through direct control of the drive tong, or they may be mechanical in nature and directly applied to one or more of the tubular segments being made up. In the following discussion and in the claims, the terms "including" and "comprising" are used in an open-ended fashion, and thus should be interpreted to mean "including, but not limited to . . . ."

DETAILED DESCRIPTION

The following discussion is directed to various embodiments of the invention. Although one or more of these embodiments may be preferred, the embodiments disclosed should not be interpreted as, or otherwise be used for limiting the scope of the disclosure, including the claims, unless otherwise expressly specified herein. In addition, one skilled in the art will understand that the following description has broad application, and the discussion of any particular embodiment is meant only to be exemplary of that embodiment, and not intended to suggest or imply in any way that the scope of the disclosure, including the claims, is limited to that embodiment.

Various embodiments of the invention described herein overcome inefficiencies in prior art techniques for making up connections between threaded tubular joints. When making up a connection, thread interface frictional forces and pin nose to shoulder contact forces must be overcome to permit further rotation and axial advancement of the of pin to ensure power-tight status of the connection. In prior art make-up processes, this is supposed to happen during the short time during which the torque spikes to maximum before the tong is shut down. Due to inefficiencies in the process (e.g. increasing grip pressure, grip slippage, radial deformation at the grip points, circumferential deformation (twisting) of the joint body, etc.), it is unlikely that much of the energy produced by the maximum torque is dissipated throughout the threaded portion of the connection to produce an optimal connection; rather a significant portion of the energy associated with the torque spike is likely lost to those inefficiencies.

The various embodiments of the present invention overcome this by introducing an impulse energy component over the primary rotational force that has been heretofore conventionally provided by a tong. The impulse energy component can be generated, for example, through direct control of the tong as a secondary torque component or through direct mechanical contact with the segment to which the conventional torque is being applied. This impulse energy component, when provided in conjunction with the conventional torque component supplied by the tong, provides impulse energy to the segment to overcome the various losses in rotational energy that otherwise short-circuit further rotation and thus axial advancement of the pin within the box of a connection as the torque spikes.

The impulse energy component may be introduced during the connection make-up process at a predetermined onset torque threshold value and then maintained for a predetermined duration until reaching a maximum time threshold, or may it be introduced and removed based on two predetermined measured torque threshold values, in the form of an onset torque threshold and maximum torque threshold. This application of an impulse energy component can be a secondary torque component having a mean level and secondary amplitude, or as mechanical perturbations made directly to one or more of the tubular segments being made up. The impulse energy component produces impulse energy to overcome localized friction and successfully translates to additional rotation and/or advancement in the connection beyond that achieved by known connection make-up processes. Achieving this additional rotation and/or axial advancement results in a more properly torqued connection that is more optimally locked together and thus is not as susceptible to loosening due to forces being applied to the joints while in service, when compared to a connection made-up in accordance with methods currently known in the art.

Figure 2:
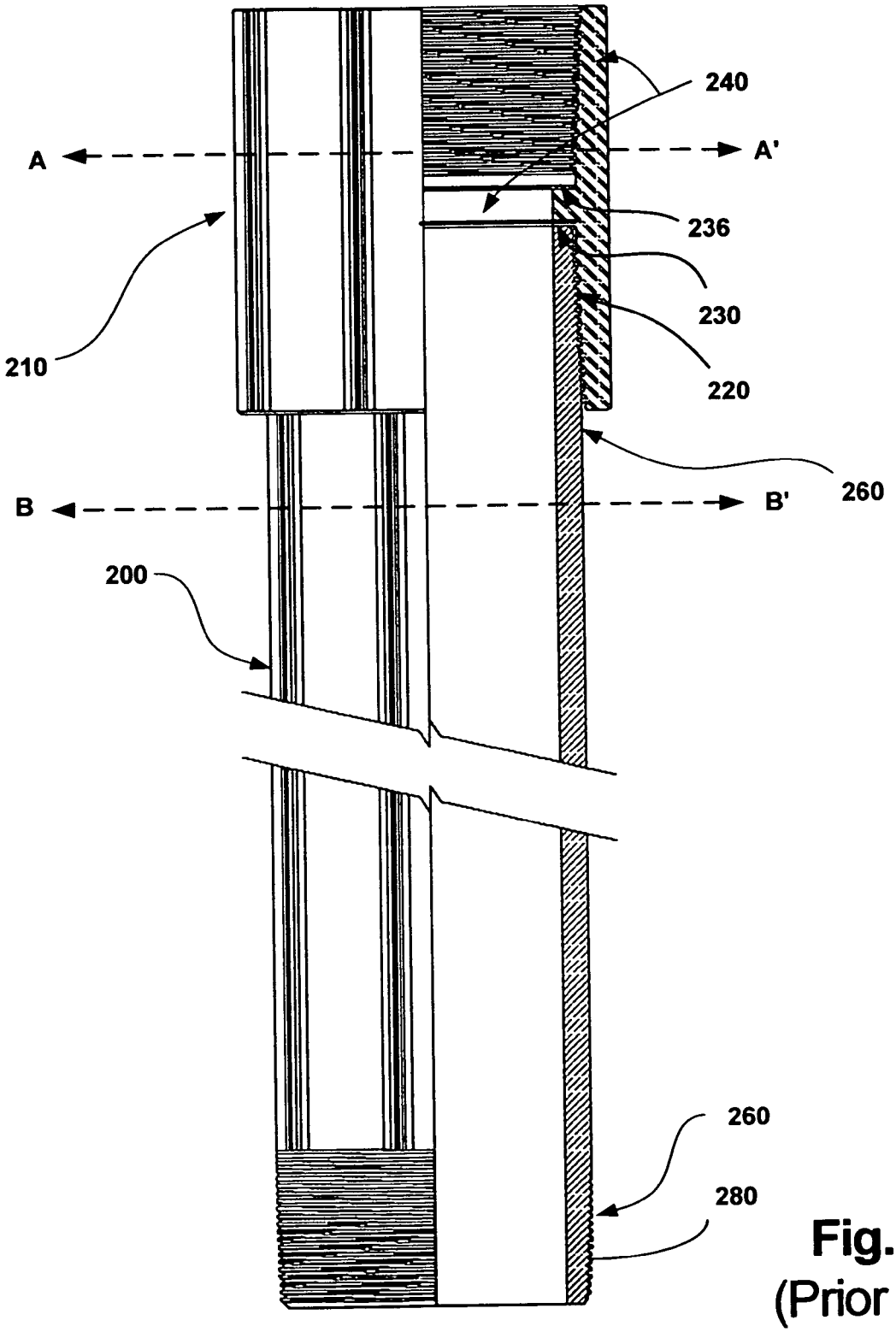
Fig. 2 (Prior Art)
FIG. 2 is an illustration of a type of tubular segment having external threaded male members machined on both ends of the same joint, and a separate coupling having internal female threads connected to one end of the segment, that together are used to form a coupled connection with other such segments as is known in the art.

With reference to FIG. 1, a segment of pipe or other tubular member 100 that may be connected together as a string using an automated oilfield make-up process is illustrated The pipe joint or segment 100 is known as an integral joint and consists of an internally threaded 120 female member 140 at one end and an externally threaded 180 male member 160 at the opposite end. The male or pin member 160 is designed to mate with the female or box member 120 of another such tubular segment (not shown). FIG. 2 illustrates a tubular segment or joint 200 having externally threaded 280 male or pin members 260 machined on both of its ends. To establish a connection with another such tubular joint or segment (not shown), a separate internally threaded coupling 210 is used to secure pin members 260 of the two tubular segments together.

The pin 160 and box 140 members for the integral joint of FIG. 1, as well as the pin members 260 and the coupling 210 of FIG. 2 typically employ helical threads that are machined on a taper to form conical members. Various threadforms (i.e. combinations of characteristic elements of the threads such as thread height, lead, pitch, and flank angles) are in use today. Industry standards known as "buttress" and "eight-round" have been established by the American Petroleum Institute. A number of proprietary/specialty threadforms have also been designed to enhance connection performance. Many connections also have a final surface treatment applied to one or both members. Surface treatments may consist of attaching a soft, malleable metal to the external thread surface for added lubricity (designed to prevent galling of the threads) and to improve leak resistance by filling microscopic imperfections in the surface from the machining process. Surface treatments will affect the friction developed at the mating thread surface during assembly and thus may vary the amount of torque required to create a viable connection between the joints.

In addition, the industry has developed numerous lubricants, known as thread compounds, for use in connection assembly. These compounds are multi-functional, providing lubrication to reduce galling (localized threadform damage) and enhanced leak resistance through incorporation of various metallic and non-metallic fillers. There is a wide range of friction factors across commonly used thread compounds that correspondingly affect the torque required for successful connection assembly. The various embodiments of the invention disclosed herein are intended to work with, and to improve the integrity of, connections employing all such variations in connection, threadform, surface treatment(s) and thread compounds.

Figures 3A, 3B, 3C:
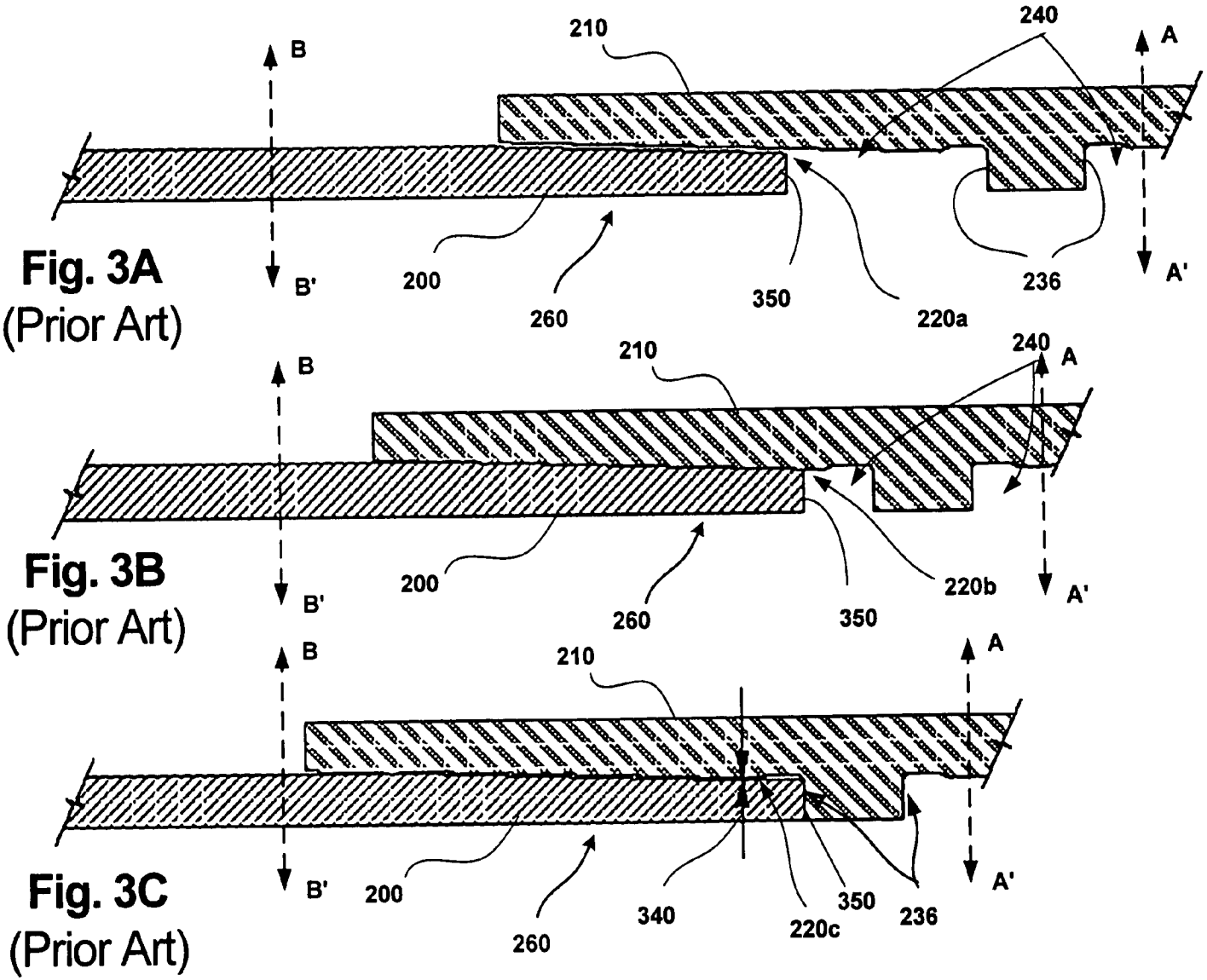
Fig. 3A (Prior Art)
Fig. 3B (Prior Art)
Fig. 3C (Prior Art)
FIG. 3A is a cross-sectional view of the joint and coupling of FIG. 2 at the introduction of the pin or externally threaded male member of the segment to the box or internally threaded female member of the coupling as is known in the art.
FIG. 3B is a cross-sectional view of the joint and coupling of FIG. 2 where the two cones of the segment and the coupling are precisely mated, a connection state commonly referred to as the "hand-tight" position, as is known in the art
FIG. 3C is a cross-sectional view of the joint and coupling of FIG. 2 where the combination of thread interface friction along with pin and box deformation (circumferential and axial) has been overcome by the torque applied to both members to achieve the ideal prescribed positional makeup, a connection state known in the art as "power-tight."

With reference to FIGS. 3A-C as well as FIG. 2, an overview discussion of a typical process of making up a connection as presently known in the art is presented. As is known to those of skill in the art, during make-up each of the segments is gripped by a series of hydraulically operated, cam-actuated chucks that are part of a unit called a tong. Each chuck has a radial set of dies that physically engage and "bite" into the external surface of the segment OD (outside diameter). Once the segments have been properly secured in the chucks, the upper joint is turned with a typically hydraulic mechanism housed in the tong unit. The tongs are allowed to float in all directions relative to the fixed lower joint to avoid putting the connection into a bind.

A section of the tubular segment 200 and coupler 210 of interest is defined by lines A-A' and B-B' of FIG. 2 and has been isolated for illustrative purposes in FIGS. 3A-C. Typically, the heretofore known make-up process consists of applying torque to screw one conical pin member 260 into another receiving conical member (the box) 240 such as is formed in two ends of the coupling 210. At the introduction of pin to box, the diameter of the external conical pin 260 is smaller than the diameter of the internal conical box 240, as is illustrated in FIG. 3A (shown where the threads are not yet coupled at thread interface 220*a*).

At a certain point of axial advancement of pin 260 into the box of coupler 210, the two cones and their respective threads are precisely mated as indicated by the state of the thread interface 220*b*, FIG. 3B (220, FIG. 2). This state, as illustrated in FIG. 3B, is commonly referred to the "hand-tight" position. Theoretically, no torque is required for advancement of the pin 260 to the hand-tight position. In reality, however, as the pin 260 advances into the box 240, thread interference develops at the thread interface 220*b* and the torque required for axial advancement increases due to building friction along the threadform mating surface as well as structural deformation (circumferential and longitudinal) of the pin 260 and box 240 members. This is reflected in the idealized torque vs. turns plot illustrated in FIG. 4B.

Axial advancement of the pin member 260 beyond the hand-tight position in the box 240 of the coupling 210 requires application of significant torque as the external conical surface of the pin 260 ramps against the internal conical receiving surface of the box 240 to generate the reactive forces 340 as illustrated in FIG. 3C. As the pin is rotated further, the mating helical threads at thread interface 220*c* screw-jack the pin 260 further into the coupling 210. Additional advancement requires increasing applied torque to overcome thread interface friction and deformation of the pin 260 and box 240 members. This is reflected in the idealized torque vs. turns plot illustrated in FIG. 4B. The box member 240 expands circumferentially while the pin member 260 circumferentially deforms compressively as indicated by forces 340. Coincidentally, both members also deform axially; the box 240 bends axially outward and the pin 260 bends axially inward. The combination of thread interface friction along with pin and box deformation (circumferential and axial) must be overcome by the torque applied to both members to achieve a prescribed positional makeup, known in to those of skill in the art as "power-tight." This connection state is illustrated in FIG. 3C.

Figure 4A:
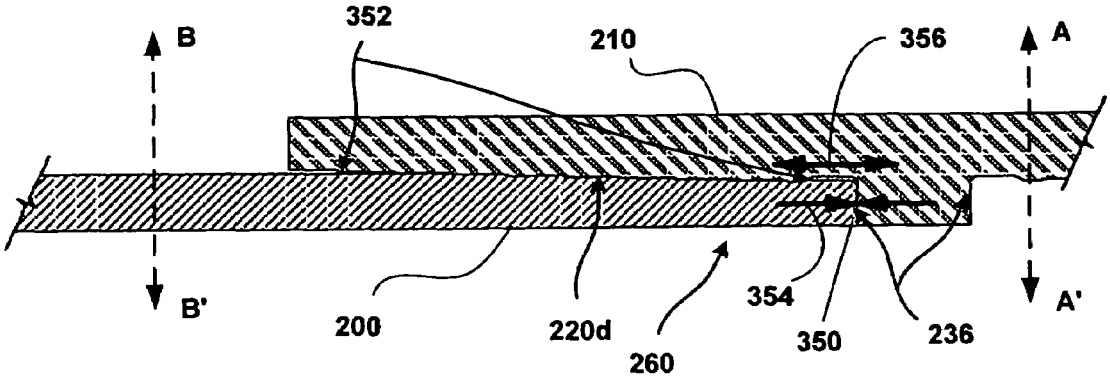
FIG. 4A is a cross-sectional view of the joint and coupling of FIG. 2 wherein the coupling has internal shoulders that facilitate a positive stop to axial advancement of the pin member of the segment as is known in the art.
Figure 4B:
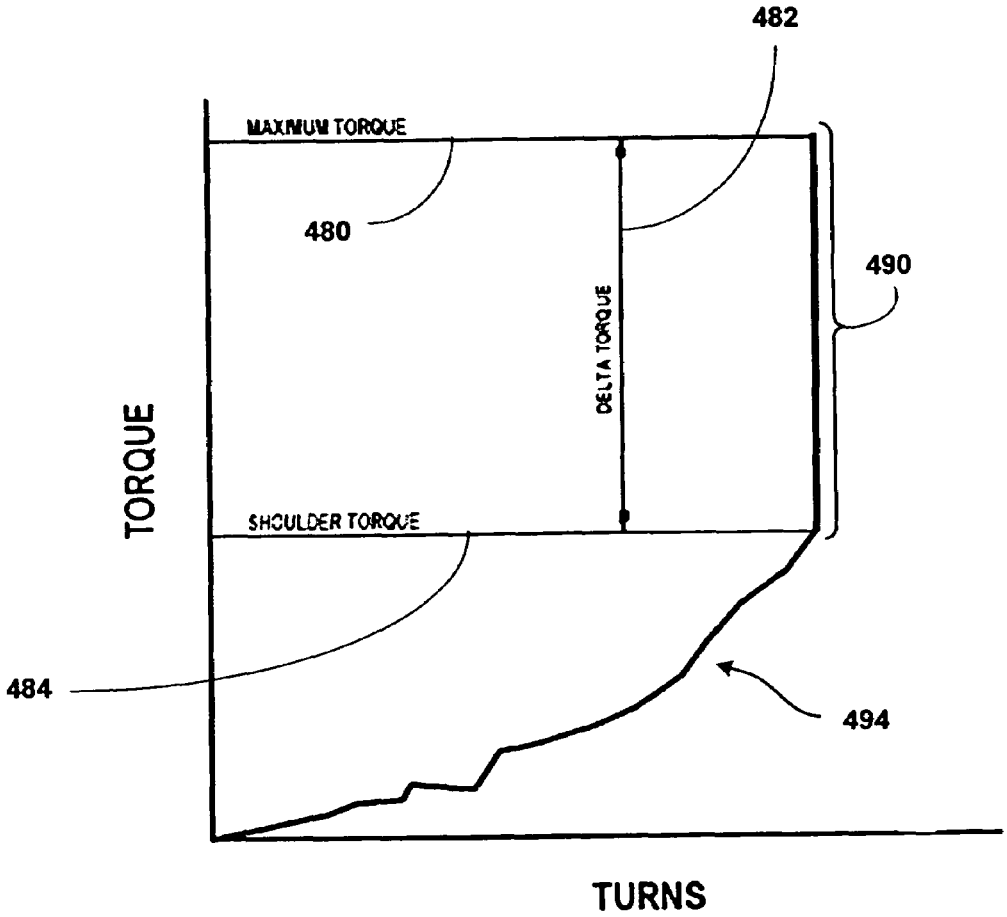
FIG. 4B illustrates an idealized torque vs. turn plot for a shouldered connection as is illustrated in FIG. 4A.

Often, the box members of integral joint and coupled connections have internal shoulders 236 that facilitate a positive stop to axial advancement of the pin member. When the pin nose 350 engages the stop 236, the connection is said to shoulder-out. This state is illustrated in FIG. 4A. When shouldering occurs, rotation stops and an immediate and instantaneous spike in the torque is experienced as the tong attempts to create further rotation. In the process of making up shouldered connections, three torque measurements are typically recorded. The torque-to-shoulder and the maximum torque are direct measurements. Shoulder torque is defined as the torque at which axial advancement of the pin 260 into the box 240 stops. At this point the torque reading spikes. Delta torque is the difference between maximum torque and shoulder torque. FIG. 4B is an idealized torque vs. turn plot for a shouldered connection. This plot shows the continuous torque generated by the tong up to and including the shoulder torque 484, the delta torque 482 and the maximum torque 480 points on the curve. Some connections, such as those tubular connections in oilfield applications, require a certain amount of delta torque to be achieved to assure the two members are sufficiently locked together.

For shouldered connections as described above, the torque supplied by the drive tong to maintain rotation spikes when axial advancement of the pin stops, due to thread flank interface and/or shoulder engagement frictional forces. Most makeup units have apparatus to automatically shut down the tong at some specified maximum torque value. This avoids over-torqueing the connection and associated potential damage to the pipe and/or connection OD as the chuck pressure increases. Those of skill in the art will be familiar with commercially available torque control systems such as those manufactured by Eckel Manufacturing Company, Inc. More detailed information regarding these tong control systems may be obtained at their web site at www.eckel.com. As previously discussed, while it is likely that the applied torque has been properly measured by such a control unit when practicing the foregoing prior art make-up process, it is unlikely that the torque applied by the tong effectively overcomes localized thread interface friction throughout the connection (i.e. in the threads and/or torque shoulders of the coupled joints). This fact can lead to a failure of the connection later under extreme environmental conditions, as previously described, even though the prescribed maximum torque and delta torque have actually been achieved.

There is only a short duration of time from initiation of the torque spike (490, FIG. 4B) to tong shutdown (measured in milliseconds). That fact in combination with all of the localized deflection(s), increasing grip bite, slight grip slippage, hydraulic and other mechanical inefficiencies, it cannot be ensured that the energy generated by the measured delta torque is sufficient to overcome localized friction throughout the mating threads (220*d,* FIG. 4A) (i.e. between the grip points of the threads 352 and into the shoulder 236 (if any)) to complete an ideal power tight makeup state in the connection. Put another way, once the torque spike (490, FIG. 4B) has occurred, it cannot be ensured that thread interface frictional forces 356 plus pin nose/shoulder contact forces 354 are overcome to permit further rotation of pin 260 (axial advancement) during such a short duration of the maximum torque (480, FIG. 4B). Rather, the energy generated by this high torque is prone to dissipation in increasing grip pressure and slippage, radial deformation at the grip points between tong and joint, as well as circumferential deformation (twisting) of the joint body.

Attempts have been made to compensate for this energy loss in the past by prescribing a predetermined maximum torque level which coincidentally results in a large delta torque. The tongs are then shut down and a longitudinal line is scribed across the connection/joint interface. Torque is then applied a second time to the same level of magnitude. Some additional rotation has been observed using this technique as indicated by separation of the scribed lines, thus indicating a further tightening of the connection. This solution is more time consuming and it still does not guarantee that the connection has reached the desired power tight state.

Figure 5:
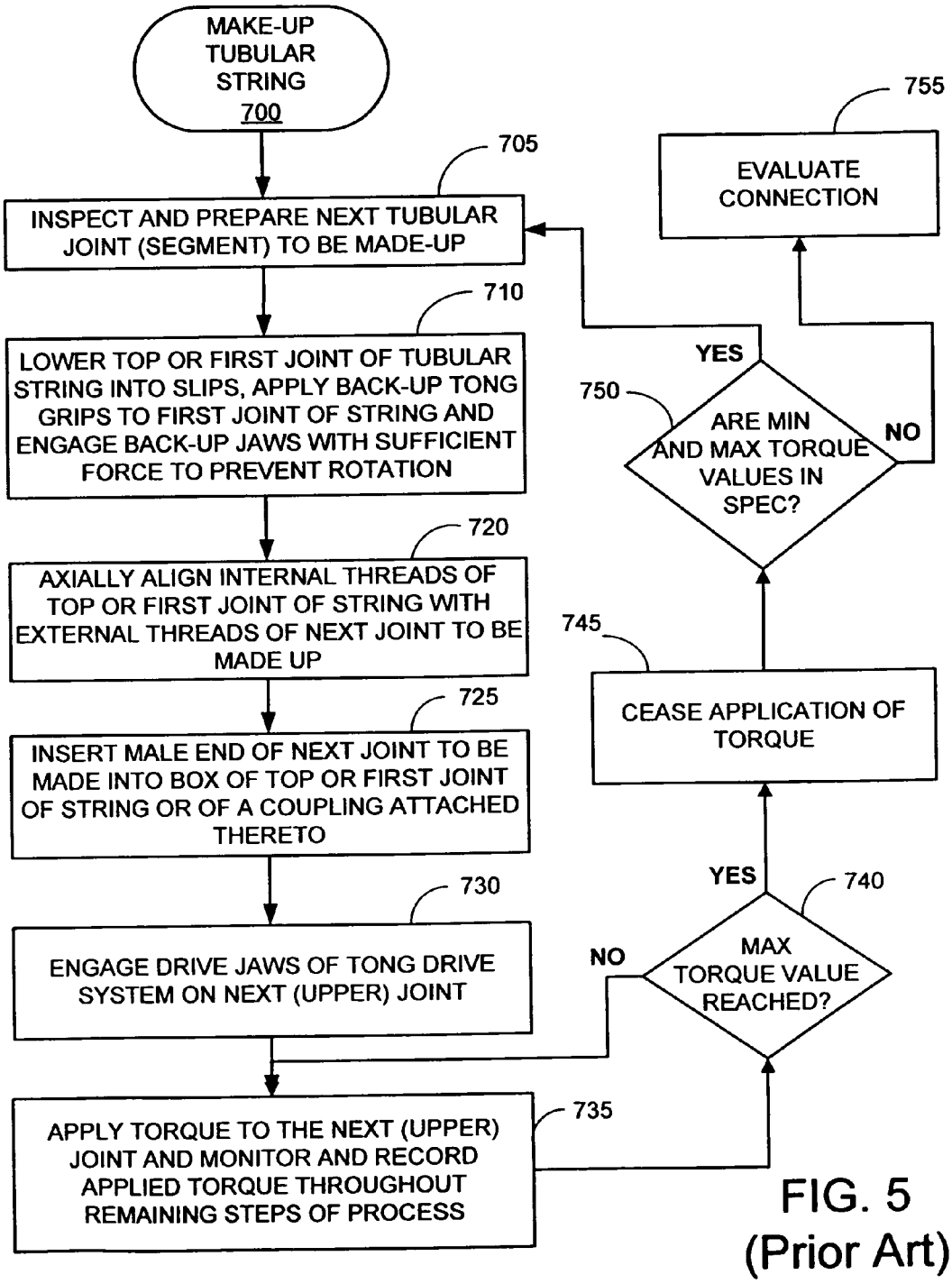
FIG. 5 (Prior Art)
FIG. 5 is a process flow diagram illustrating a tubular connection make-up process as is known in the art.

FIG. 5 is a flow diagram that illustrates a typical make-up process of a shouldered connection as is known the art. At 705, the next segment to be coupled to the string is inspected. At 710, the top segment of the string (i.e. the last segment to be coupled to the string or the very first) is secured to prevent rotation. At 720, a pin or male member of the next segment or joint is axially aligned with a box member of the top segment or a coupling attached thereto, and at 725 the pin or male member of the next segment is inserted into the box of the top segment or coupling attached thereto. At 730, the jaws of the upper or drive tong are engaged with the next segment under control of a tong controller. At 735, rotational force is applied to the next segment and monitoring equipment associated with the tong controller is engaged to detect the spike in torque experienced when the pin nose shoulders out within the box. At 740, the current value of the applied torque is compared to the maximum torque and if applied torque has reached maximum torque, the tong drive is shut down and thus the application of rotational torque is shut-down at 745. The recorded applied torque is then reviewed to determine if a predetermined value of delta torque has been achieved at 750. If yes, the process is repeated beginning at 705 for the next segment unless the string is complete. If no, the connection is evaluated at 755 to determine if additional torque must be applied or if the connection needs to be broken out and re-made.

Figure 6:
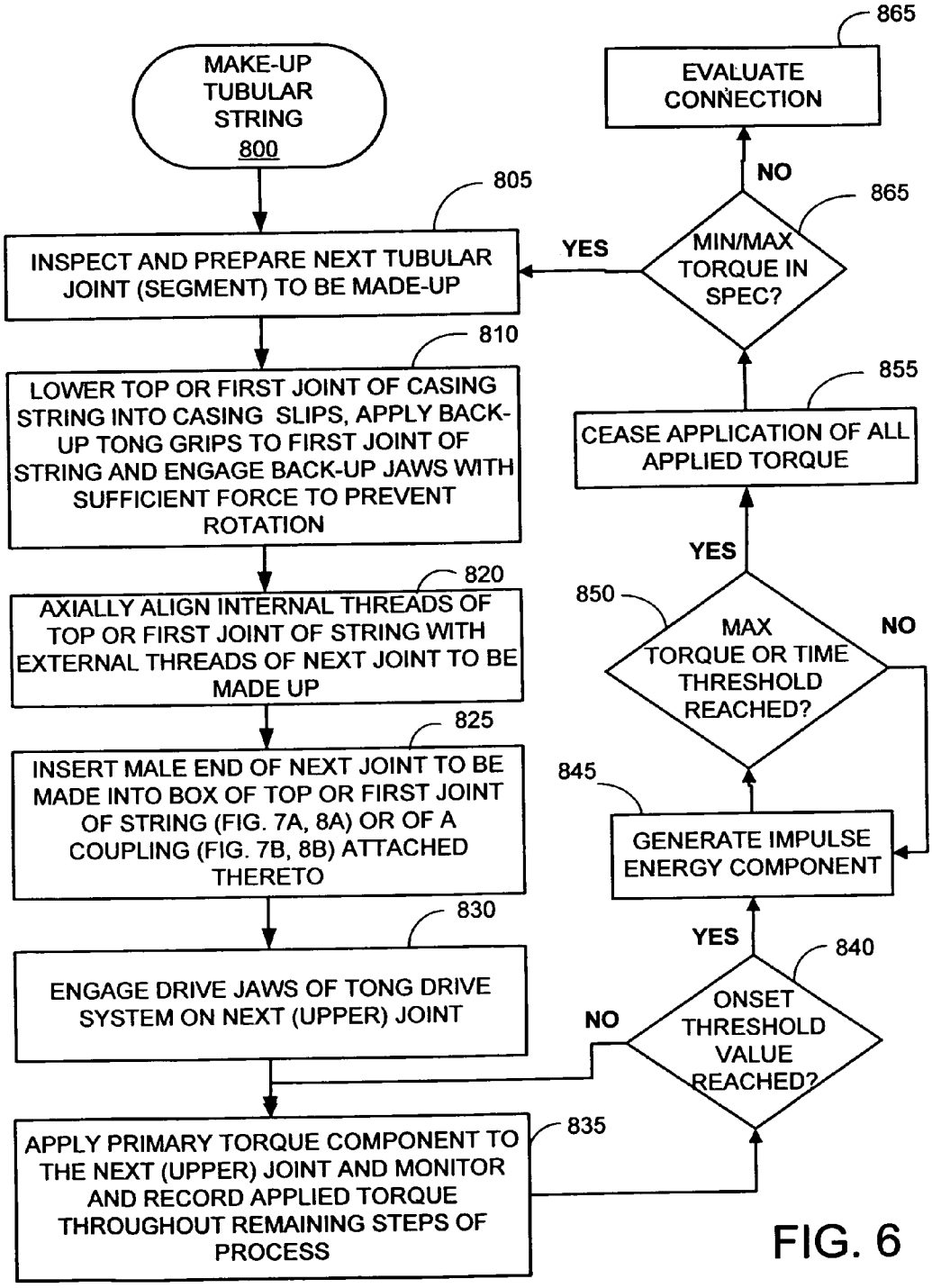
FIG. 6 is a process flow diagram illustrating an embodiment of a tubular connection make-up process in accordance with aspects of the invention.
Figure 7A:
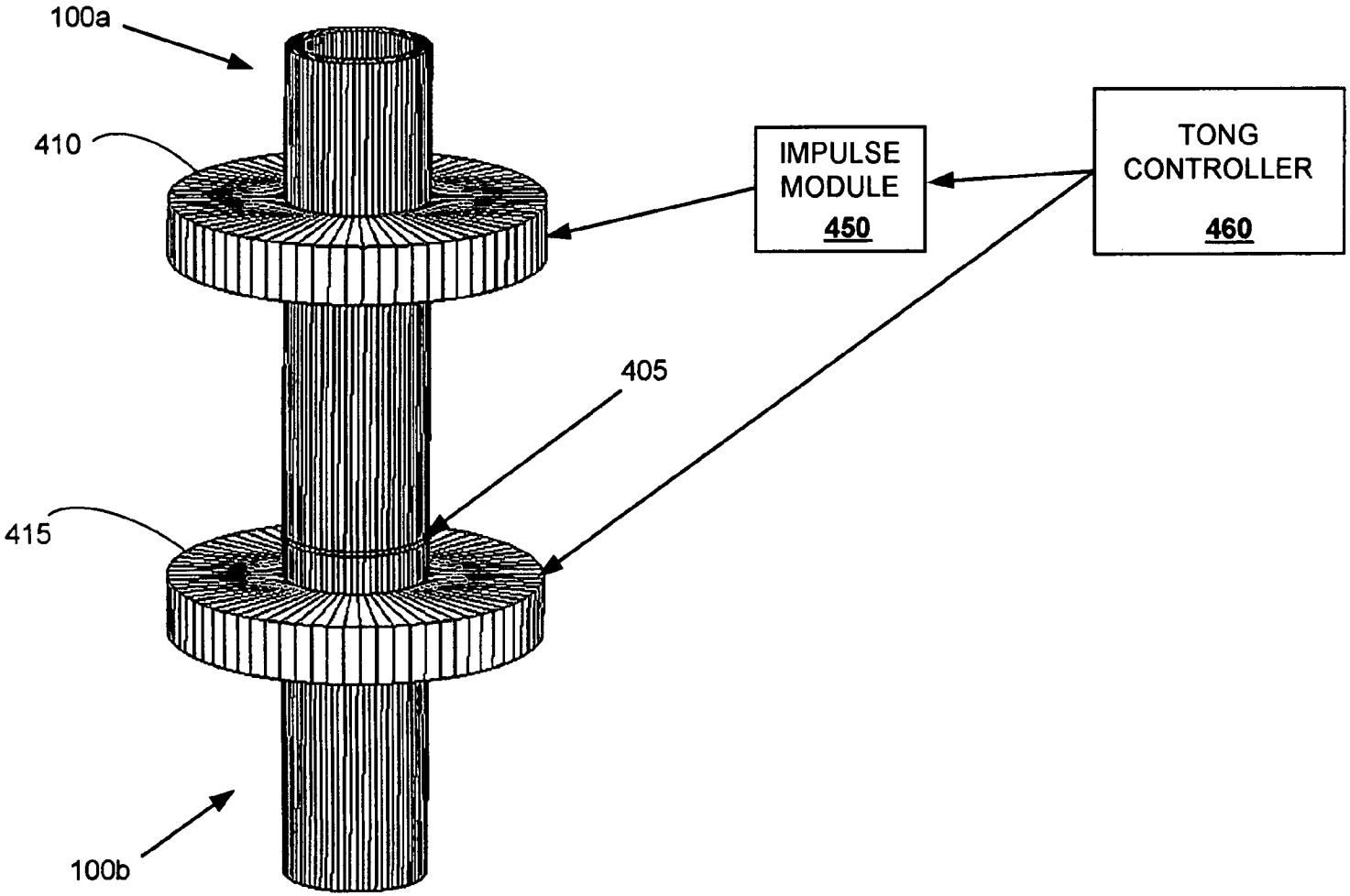
FIG. 7A is a block diagram illustrating an embodiment of a tubular connection make-up system that is making up a connection between two integral joints, such as those illustrated in FIG. 1, in accordance with various aspects of the invention.
Figure 7B:
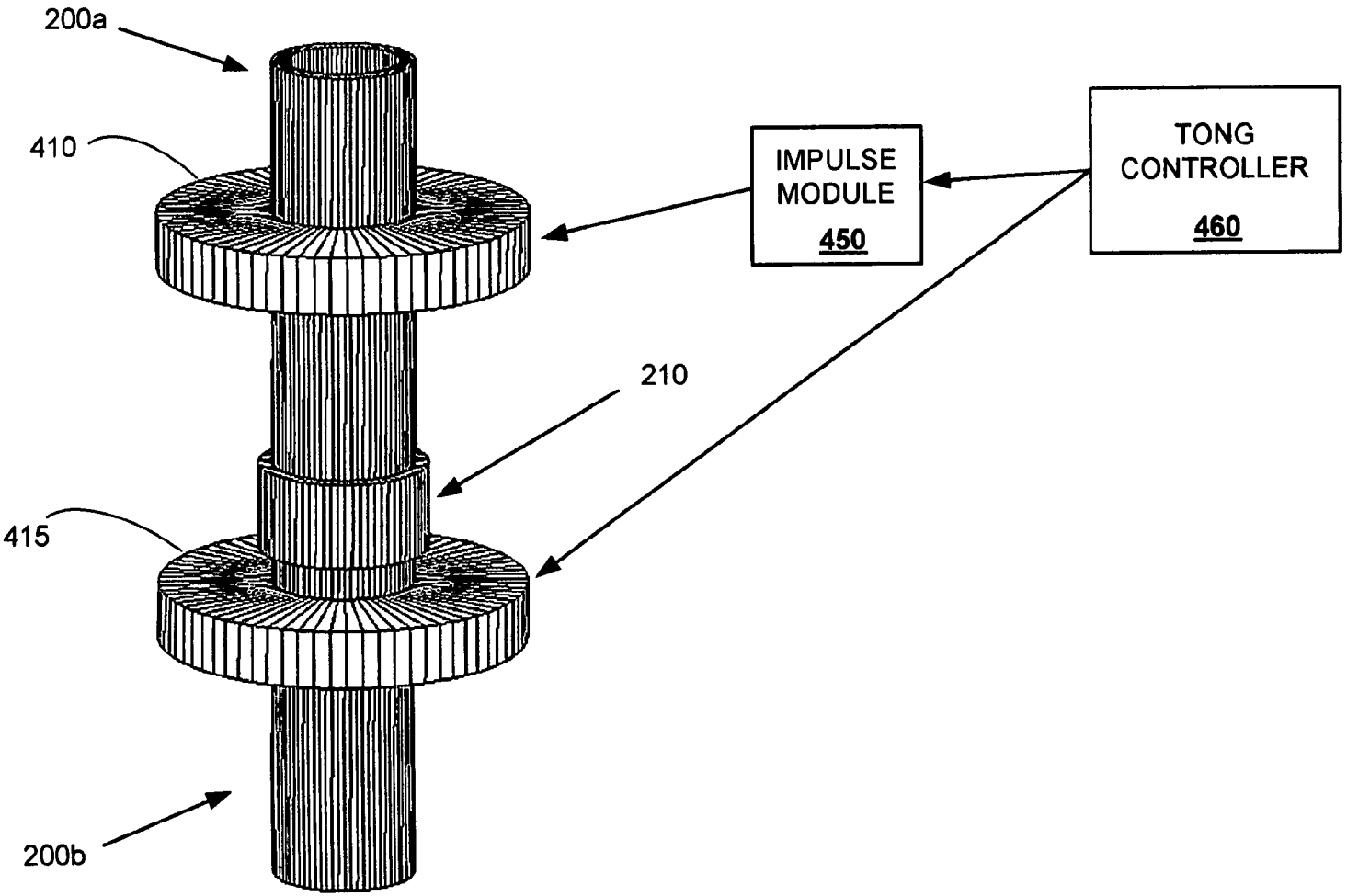
FIG. 7B is a block diagram illustrating an embodiment of a tubular connection make-up system making up a coupled connection, including a coupling such as that illustrated in FIG. 2, in accordance with various aspects of the invention . . . .

FIG. 6 is a process flow diagram describing an embodiment of a make-up process in accordance with the invention. FIG. 7A illustrates an embodiment of a connection make-up system that implements the process of FIG. 6 to make up connections between integral joints such as the integral joint 100 of FIG. 1. FIG. 7B illustrates an embodiment of a connection make-up system that implements the process of FIG. 6 while making up connections between joints using external couplings such as the joint 200 and external coupling 210 of FIG. 2. Segments 200*a,* 200*b* for this type of connection illustrated in FIG. 7B typically come preassembled with a coupling 210 already made-up at one end of the segment 200*b* as is known in the art. Those of skill in the art will recognize that another coupling would be typically threaded onto top joint 200*a* as well. This coupling has been omitted for purposes of simplicity in FIGS. 7B and 8B.

As in the prior art method, a first step of an embodiment of a make-up process of the invention is to inspect and prepare the next casing joint to be coupled to a string at 805 of FIG. 6. At 810, the top or first joint (100*b,* FIG. 7A; 200*b* FIG. 7B) of the string is lowered into lower slips (not shown) and the jaws (not shown) of the lower tong 415 (FIGS. 7A, 7B), which are engaged under control of tong controller 460 to prevent rotation of the top or first joint of the string (100*b,* FIG. 7A; 200*b* FIG. 7B) during the make-up process. At 820 of FIG. 6, the female threads of the top or first joint (100*b,* FIG. 7A) or of the coupling 210 coupled to the top or first joint (200*b,* FIG. 7B) of the string are axially aligned with the male threads of the next joint (100*a,* FIG. 7A; FIG. 7B). At 825 of FIG. 6, the male member or pin of the next joint (100*a,* FIG. 7A; FIG. 7B) is inserted into the female member or box of the top or first joint (100*b,* FIG. 7A) or of the coupling (210, FIG. 7B) of the string.

Figure 8A:
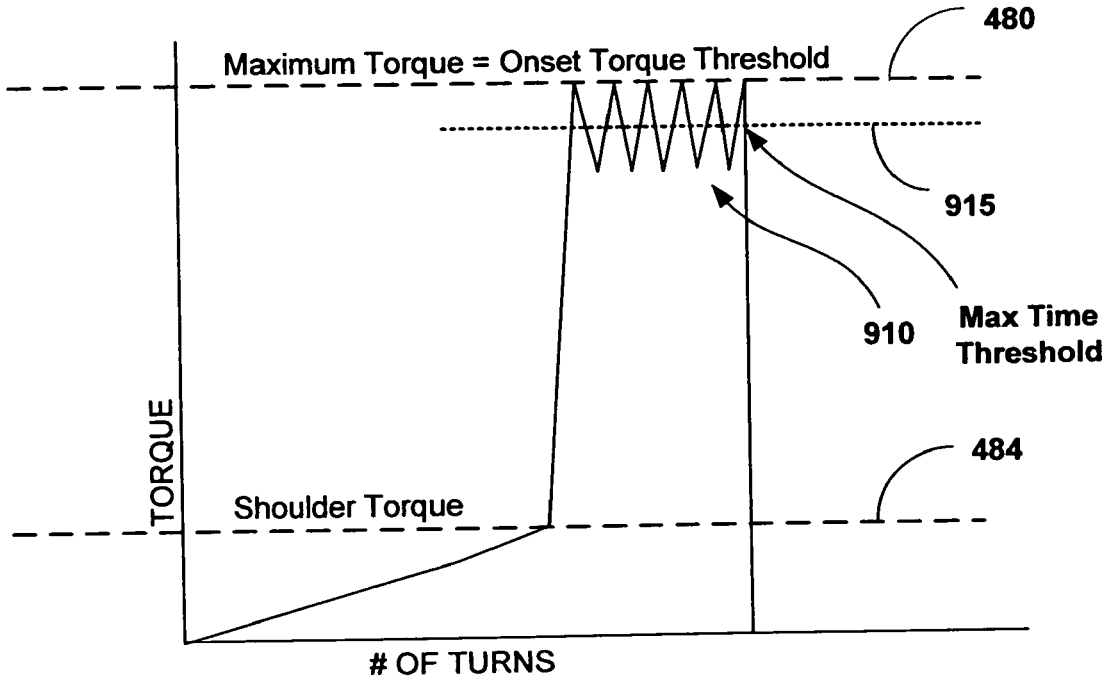
FIG. 8A is a torque vs. turns plot illustrating the imposing of an impulse energy component over the conventional torque component up to a predetermined maximum time threshold after reaching a maximum torque threshold in accordance with various aspects of the invention.

At 830, the drive jaws (not shown) of the upper or drive tong 410 are actuated by impulse module 450 under control of the tong controller 460 to engage the next joint 110*a.* At 835, rotational torque is applied to upper drive tong 410 under control of tong controller 460 through impulse module 450. The tong controller 410 receives feedback from the upper tong 410 regarding the amount of torque required to achieve and maintain rotation of the next joint 100*a* and detects when a first predetermined onset threshold torque value is reached. In an embodiment, this onset threshold can be the maximum torque 480 that is achieved when rotational arrest occurs. This will be evidenced by the virtually instantaneous spike in torque as described above. This is illustrated by the plot of FIG. 8A. The plot of FIG. 8B illustrates an embodiment where the onset torque threshold 930 is a torque value that is less than the maximum torque 480.

Figure 8B:
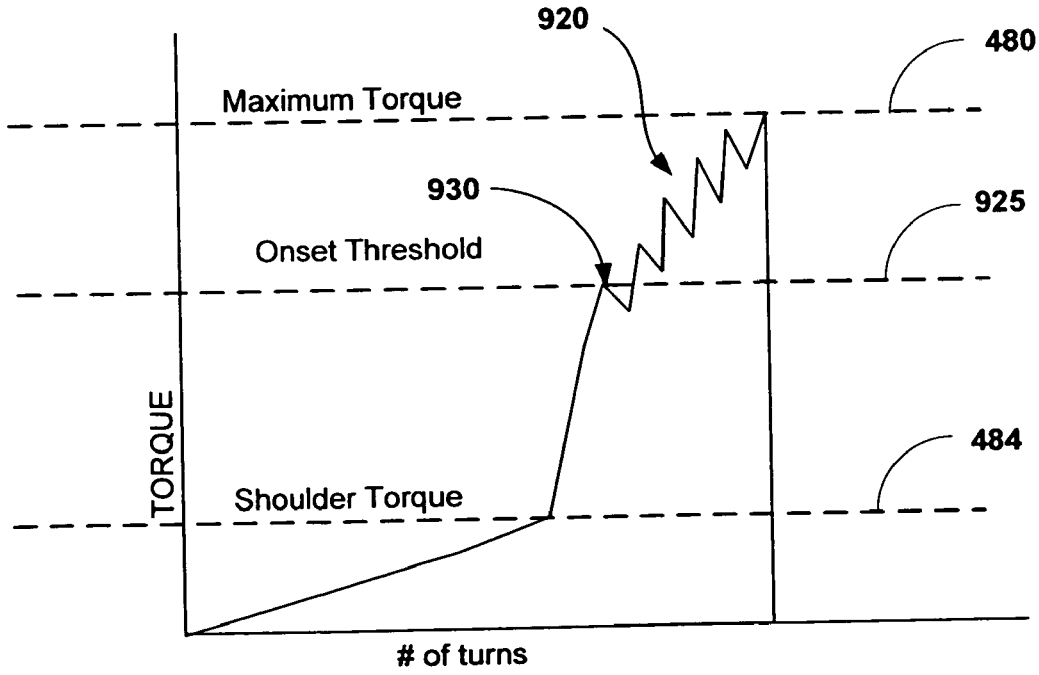
FIG. 8B is a torque vs. turns plot illustrating the imposition of an impulse energy component over the conventional primary torque component between two predetermined torque threshold values in accordance with various aspects of the invention.

The controller 460 monitors for this onset torque threshold at 840 is applied When this threshold is met, processing continues at 845 at which time impulse module (450, FIGS. 7A and 7B) generates an impulse energy component in the form of a secondary torque component 910, FIG. 8A or 920, FIG. 8B) on top of the primary torque component and is maintained by the drive tong 410, FIG. 7A, 7B. As previously mentioned, the secondary torque component 910, 920 may be any form of time varying torque waveform, including but not limited to a sine wave, a saw tooth, a square wave, triangle wave, pulse wave, high frequency vibration or even random and non-periodic. In an embodiment, the amplitude of the secondary torque component 910 is such that the amplitude peaks at or near the maximum torque 480 as illustrated in FIG. 8A and has a mean value 915 that can be, for example, at about 10% below the maximum torque value 480.

Referring back to FIG. 6, at 850 a predetermined time or maximum torque threshold is monitored until met. FIG. 8A illustrates the use of a predetermined maximum time threshold as the point of discontinuing the secondary as well as the primary torque components. FIG. 8B illustrates an embodiment that employs a maximum torque threshold=the maximum torque 480 as the point for turning off the secondary as well as the primary torque component When the threshold is reached or exceeded, processing continues at 855 at which time the primary torque component as well as the secondary torque component provided by way of the tong drive through the impulse module 450 is reduced to zero. The connection is then examined at 865 to ensure that the minimum and maximum torque specs have been met during make-up and if so, processing continues with the next pipe segment to be added to the string at 805. If not, the connection is evaluated further at 865 to determine if it must be redone.

In an embodiment, the secondary torque component (910, FIG. 8A; 920, FIG. 8B) can be generated, for example, by impulse module 450 causing the hydraulic pressure driving the upper tong 410 to reciprocate for rapid variation of the applied torque to drive tong 410. Those of skill in the art will appreciate that the impulse module 450 may be distinct from the tong controller 460, or it may be integrated within the tong controller 460, as for example, a software routine that is called by the tong controller 460 at the appropriate applied torque threshold.

Figure 9A:
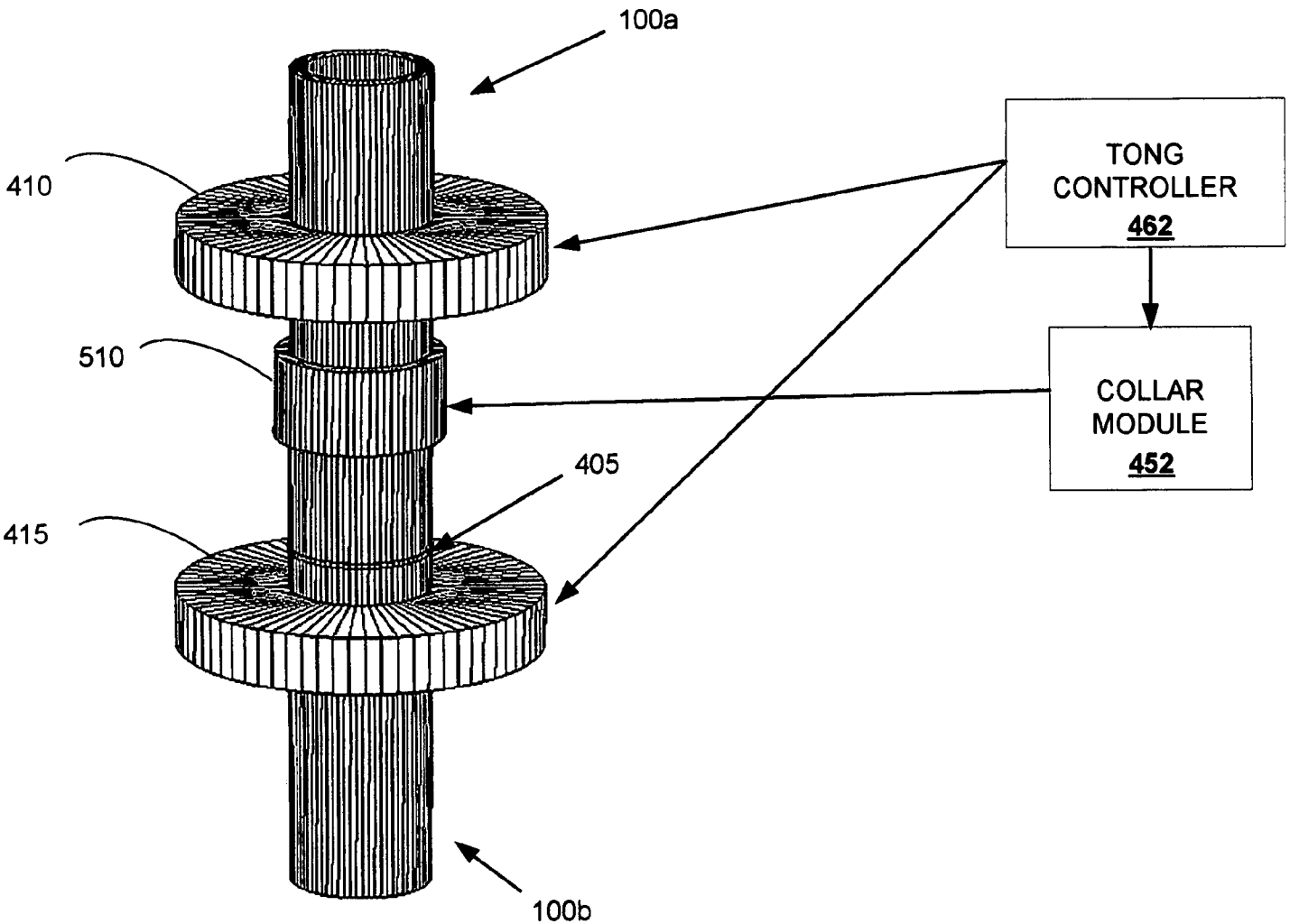
FIG. 9A is a block diagram illustrating an embodiment of a make-up system that is making up a connection between two integral segments or joints, such as those illustrated in FIG. 1, employing an impulse energy collar in contact with at least one of the joints in accordance with various aspects of the invention.
Figure 9B:
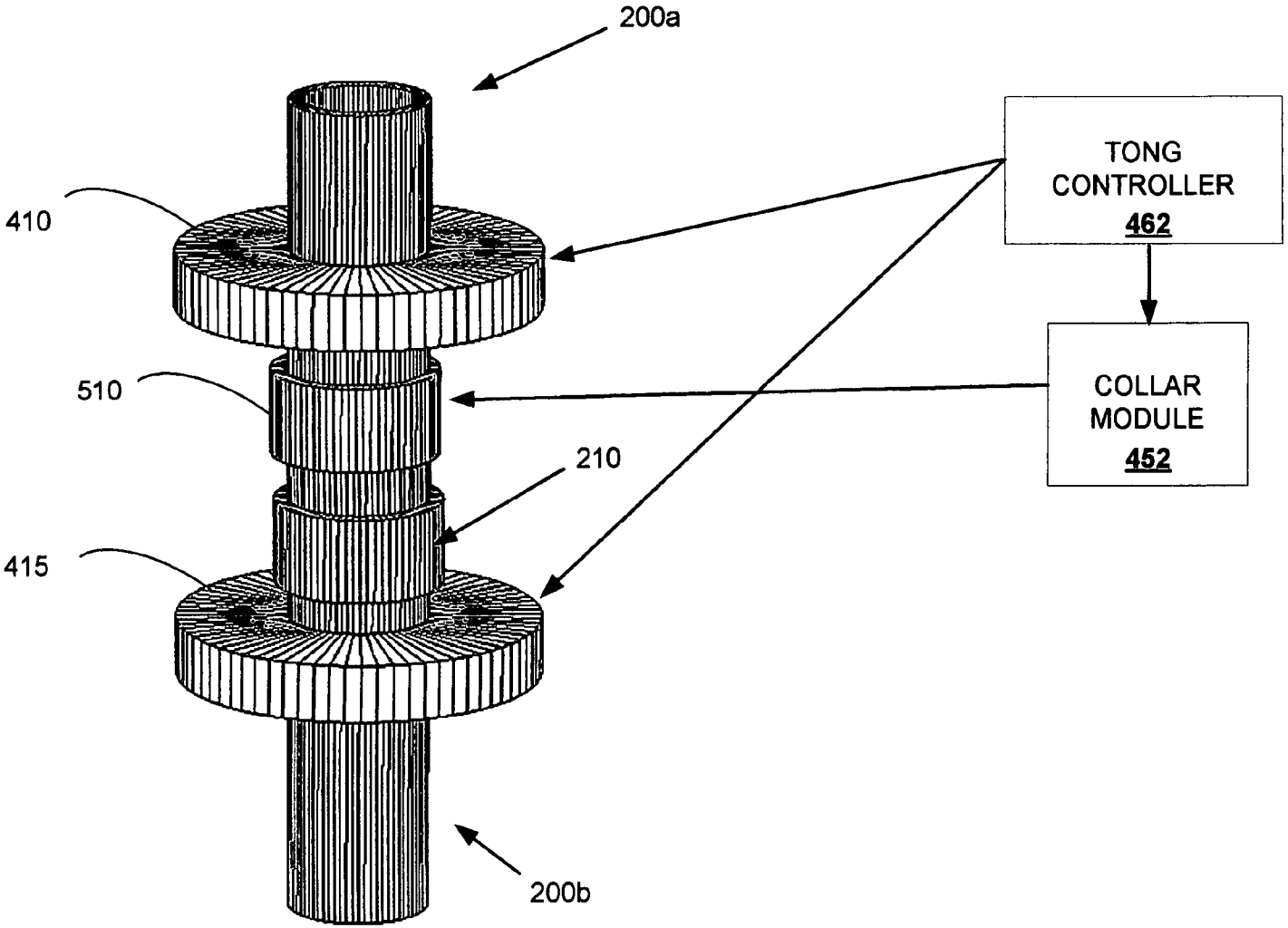
FIG. 9B is a block diagram illustrating an embodiment of a make-up system that is making up a connection with a coupling such as that illustrated in FIG. 2, employing an impulse energy collar in contact with at least one of the joints in accordance with various aspects of the invention.

In another embodiment, the impulse energy component can be generated through use of an impulse energy collar that is in direct mechanical contact with one or both of the top joint and the next joint to be made-up by the process of FIG. 6. FIGS. 9A and 9B illustrate such an embodiment for application to the connector types of FIGS. 1 and 2 respectively. In this embodiment, impulse energy collar 510 is in direct mechanical contact with the next joint 100*a*, FIG. 9A and 200*a*, FIG. 9B. In this embodiment, the upper 410 and lower 415 tongs are controlled by the tong controller 460 as previously described in the embodiment of the make-up process of FIG. 6. In the embodiment of FIGS. 9A and 9B, however, the impulse energy component is generated at step 845 by the impulse collar through mechanical perturbations imparted directly to the segment(s) being made-up. Those of skill in the art will appreciate that the impulse energy component supplied by collar 510 serves to produce impulse energy at the thread interface of the threaded connection to aid the conventional torque component produced by the drive tong 410 in overcoming the resistive forces in the threads leading to further rotation and axial advancement of the pin, notwithstanding the inefficiencies described above.

An embodiment employing a collar 510 is illustrated in FIG. 9A (for an integral connection) and FIG. 9B (for coupled connection). In an embodiment, the applied torque onset threshold value 930, FIG. 8B as detected by tong controller 460, initiates the collar controller 450 to actuate the collar 510 to initiate introduction of an impulse energy component 930 over the primary torque component through a mechanical perturbation of joint 100*a* (FIG. 9A) or 200*a* (FIG. 9B). It will be appreciated by those of skill in the art that the onset threshold value 930 at which the mechanical perturbations are initiated can be prior to the shoulder torque value 484, as well as at or subsequent to the shoulder torque value 484. Moreover, the amplitude of the mechanical perturbations can be any that provides the desired effect of further axial advancement of the pin. The nature of the perturbations can range from vibrational to more hammer-like than vibrational. Moreover, in an embodiment, a collar 510 may be coupled to the stationary bottom segment 200*b* as well as the rotating top or next segment 200*a*.

Figure 10:
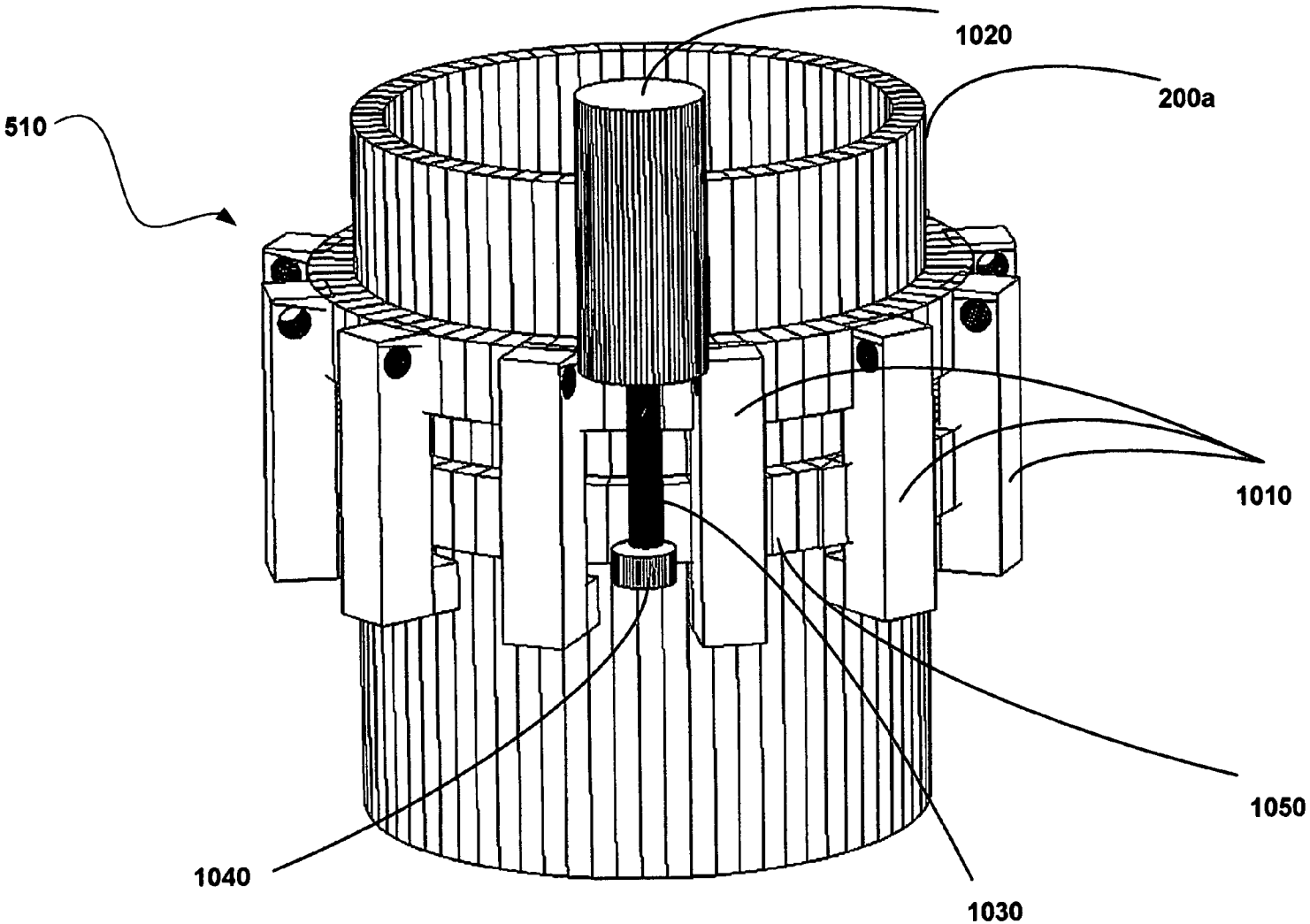
FIG. 10 is an embodiment of an impulse energy collar in accordance with the invention.

In an embodiment, the impulse collar 510 of FIGS. 9A and 9B can be a self contained unit that can be fit to specific diameters of segment 200*a*. Collar 510 can be driven either by a pneumatic or hydraulic drive motor. In an embodiment collar 510 can be designed to develop clockwise or counterclockwise single point or multi point impact(s) to the segment 200*a* directly above the threaded connection. FIG. 10 illustrates an embodiment of collar 510. In the embodiment of FIG. 12, the impacts/impulses are generated by twelve individual brass pendulum gravity hammers 1010 that can be equally spaced around the segment 200*a*.

The segment 200*a* upon which a connection make-up is to be performed is fitted with a clamp comprising collar 510 (such as a split collar as shown) that is preferably fitted specifically to the outside diameter of the segment 200*a*. The collar 510 is preferably placed approximately three inches below the make-up head of the tong 410 (FIGS. 9A, 9B) and directly above the connection (405, FIG. 9A or coupling 210, FIG. 9B) that is being made up (as illustrated in FIGS. 9A and 9B). As the primary torque component is initially applied to the connection in a conventional manner through drive tong 410, the make-up computer (e.g. tong controller 462, FIGS. 9A and 9B) monitors the torque (as previously described above).

At a predetermined onset torque level, the computer can turn on a solenoid valve (not shown) through collar module 452 that controls either a pneumatic or hydraulic drive motor 1020 located in the collar 510. The internal drive motor 1020 can be coupled to drive a shaft 1030 with a spur bear (not shown) on the bottom of the shaft. The spur gear 1040 engages a cylindrical ring gear 1040 that is attached to a single or multi-lobed cam ring 1050. As the motor 1020 turns, the cam ring 1050 revolves around the segment 200*a* and under each of the brass impact hammers 1010. As the one or more cam lobes (not shown) passes each brass impact hammer 1010, the hammer 1010 is lifted away from the surface of the segment 200*a* momentarily and then allows the hammer 1010 to drop against the surface of the segment 200*a*. The twelve hammers 1010 can impact the segment 200*a* in either a clockwise or counterclockwise sequential direction and at any desired speed.

Thus, in an embodiment, one complete cycle of the cam ring 1050 yields at least twelve impacts around the circumference of the segment 200*a*. These impacts can continue until the computer measures a torque load that is equal to a predetermined maximum torque threshold limit of the connection make-up torque parameter (FIG. 8B), or a maximum time threshold (FIG. 8A). These impacts send impulses of energy through the segment 200*a*, superimposed over the rotational energy conventionally applied, and into the thread interface of the connection segment 200*a* to produce a reduction in friction along the thread flanks. This allows more of the actual torque energy to be passed into the connection to reduce the likelihood of later back off or low breakout torque in the event that the string must be retrieved.

Those of skill in the art will appreciate that other embodiments of the collar 510 can be implemented that can provide the impulse energy to the connection segment 200*a*. For example, the collar 510 could be caused to vibrate against the segment rather than to hammer it. Moreover, the number of hammers used, or the manner in which they are actuated can vary without exceeding the intended scope of the present invention. Finally, those of skill in the art will appreciate that collar module 452 could be incorporated within tong controller 462. For example, collar module 452 could be an additional software routine that is incorporated within the conventional tong controller 462 software and thus the collar motor 1020 could be actuated directly through an output from the tong controller 462. The collar module 452 is shown as a separate entity merely as a convenience.

Those of skill in the art will appreciate that the embodiment of FIGS. 6, 7A, 7B, 9A, and 9B can also be applied to the process of making up couplings 210 with segments 100*b* for later use in making up a tubular string in the field as previously described. In this application, the lower tong 415 can be adapted to secure the coupling 210 while the segment 100*b* to which it is to be attached can be aligned and inserted into the coupling 210 and made up in accordance with the process as previously described. In that case, the drive tong 410 is coupled to the segment 100*b* and rotated into the stationary coupling 210. In the alternative, the joint segment 100*b* can be secured by the lower tong 415 with the drive tong 410 being used to turn the coupling 210.

Embodiments of a tubular connection make-up process are disclosed which enhance known make-up processes by adding an impulse energy component to the rotational torque heretofore conventionally used to make-up the connections. This impulse energy component is designed to inject energy impulses into the connection segment to overcome frictional forces within the connection threads and to translate more of the conventionally applied torque to the connection. The impulse energy component can be applied in a number of ways. In one embodiment, the impulse energy component can be secondary torque component that is superimposed over the conventional or primary torque component using the hydraulic system commonly used to apply the primary torque applied in known systems. In another embodiment, the impulse energy component can be introduced through mechanical perturbations directly to the segment(s) being coupled, and can be vibrational or of higher impact.

Those of skill in the art will appreciate that the amplitude of the impulse energy component, the onset threshold and duration of its application may be varied as necessary in accordance with the application environment to ensure that the frictional forces developed in the thread surface and pin nose/shoulder interfaces are overcome to permit further axial rotation and/or advancement of the pin. Moreover, the invention disclosed herein is not intended to be limited to any particular type of tubular connection within oilfield applications. For example, the invention may be applied to making up connections for oil well casings as well as tubular connections for production strings. Nor is the invention intended to be limited to only oil field applications. The present invention may be applied to any application in which pipe or other tubular segments/joints and/or couplers must be coupled together as a string to be used under conditions that require a stable connection that is otherwise prone to backing out if sufficient torque is not applied to overcome the localized friction and resistance experienced at the point where the connection shoulders and throughout the ramp up to maximum torque.

The foregoing description is by way of example only, and changes may be made to the details of the various embodiments disclosed herein without departing from the scope of the invention which is more properly defined by the claims that follow. For example, while the embodiments disclosed herein employ shouldered connections, those of skill in the art will recognize that these embodiments may be applied to non-shouldered connections as well. Moreover, those of skill in the art will appreciate that the primary torque and impulse energy components do not have to be discontinued simultaneously as is illustrated in the embodiments. For example, application of the impulse energy component could be terminated prior to termination of the primary torque component.

What is claimed is:

1. A method of making up a tubular connection between a first and second tubular segment, each of said segments comprising an externally threaded male member at one end and an internally threaded female member at the other end, said method comprising:

inserting the male member of the first segment into the female member of the second segment;

applying a primary torque component to the first segment to engage the external threads of the first segment with the internal threads of the second segment and to advance the male member of the first segment into the female member of the second segment;

monitoring the primary torque component applied to the first segment;

generating an impulse energy component superimposed on the primary torque component when a predetermined onset threshold has been reached; and discontinuing application of one or both of the primary torque and impulse energy components when a predetermined maximum threshold has been reached.

2. The method of claim 1 wherein said generating an impulse energy component further comprises reciprocating the primary torque component applied to the first segment.

3. The method of claim 2 wherein the impulse energy component is generated by a tong controller coupled to a drive tong mechanically engaged with the first segment.

4. The method of claim 1 wherein said generating an impulse energy component further comprises imparting mechanical perturbations directly to the first segment.

5. The method of claim 4 wherein the mechanical perturbations are generated by an impulse energy collar mechanically coupled to the first segment.

6. The method of claim 5 wherein the mechanical perturbations are hammer strikes.

7. The method of claim 1 wherein the predetermined onset threshold is a torque value that is less than a maximum permissible torque value.

8. The method of claim 7 wherein the predetermined maximum threshold is a torque value that is approximately equal to the maximum permissible torque value.

9. The method of claim 1 wherein the predetermined onset threshold is a torque value that is approximately equal to a maximum permissible torque.

10. The method of claim 9 wherein the predetermined maximum threshold is a time value measured from when the predetermined onset threshold is reached.

11. A method of making up a tubular connection between a first and second tubular segment, each of said segments comprising an extremely threaded male member at one end and an internally threaded female member at the other end, said method comprising:

inserting the male member of the first segment into the female member of the second segment;

engaging the first segment with a drive tong while preventing the second member from rotating;

applying a primary torque component to the first segment through the drive tong to engage the external threads of the first segment with the internal threads of the second segment and to advance the male member of the first segment into the female member of the second segment;

monitoring the primary torque component applied to the first member;

generating an impulse energy component superimposed on the primary torque component when a predetermined onset threshold has been reached, said generating further comprising reciprocating the first torque component applied to the first segment; and discontinuing application of one or both of the primary torque and impulse energy components when a predetermined maximum threshold has been reached.

12. The method of claim 11 wherein said applying and said generating are performed by a tong controller in communication with the drive tong.

13. The method of claim 12 wherein the predetermined onset and maximum thresholds are detected by the tong controller.

14. The method of claim 13 wherein the predetermined onset threshold is a torque value that is less than a maximum permissible torque value.

15. The method of claim 13 wherein the predetermined maximum threshold is a torque value that is approximately equal to the maximum permissible torque value.

16. The method of claim 13 wherein the predetermined onset threshold is a torque value that is approximately equal to a maximum permissible torque.

17. The method of claim 16 wherein the predetermined maximum threshold is a time value measured from when the predetermined onset threshold is reached.

18. A method of making up a tubular connection between a first and second tubular segment, each of said segments comprising an externally threaded male member at one end and an internally threaded female member at the other end, said method comprising:

inserting the male member of the first segment into the female member of the second segment;

engaging the first segment with a drive tong while preventing the second member from rotating;

applying a primary torque component to the first segment using the drive tong to engage the external threads of the first segment with the internal threads of the second segment and to advance the male member of the first segment into the female member of the second segment;

monitoring the primary torque component applied to the first member;

generating an impulse energy component superimposed on the primary torque component when a predetermined onset threshold has been reached, wherein the impulse energy component is generated by an impulse energy collar in mechanical contact with the first segment; and discontinuing application of one or both of the primary torque and impulse energy components when a predetermined maximum threshold has been reached.

19. The method of claim 18 wherein the predetermined onset threshold is a torque value that is less than a maximum permissible torque value.

20. The method of claim 18 wherein the predetermined maximum threshold is a torque value that is approximately equal to the maximum permissible torque value.

21. The method of claim 18 wherein the predetermined maximum threshold is a time value measured from when the predetermined onset threshold is reached.

22. A method of making up a tubular connection between a tubular segment and a coupling, the segment comprising an externally threaded male member and the coupling comprising an internally threaded female member, said method comprising:

inserting the male member of the segment into the female member of the coupling;

engaging the segment with a drive tong while preventing the coupling from rotating;

applying a primary torque component to the segment using the drive tong to engage the external threads of the segment with the internal threads of the coupling and to advance the male member of the first segment into the female member of the coupling;

monitoring the primary torque component applied to the first member;

generating an impulse energy component superimposed on the primary torque component when a predetermined onset threshold has been reached; and discontinuing application of one or both of the primary torque and impulse energy components when a predetermined maximum threshold has been reached.

23. The method of claim 22 wherein said generating an impulse energy component further comprises reciprocating the primary torque component applied to the first segment.

24. The method of claim 22 wherein said generating an impulse energy component further comprises imparting mechanical perturbations directly to the first segment.

25. An apparatus for making up a tubular connection between a first and second tubular segment, said apparatus comprising:

a drive tong having a motor, the drive tong operable for engaging the first segment and applying one or more torque components to the first segment;

a lower tong operable for engaging the second segment and for resisting rotation of the second segment in response to the one or more applied torque components;

a tong controller coupled to drive tong motor for controlling generation of a primary torque component to engage the external threads of the segment with the internal threads of the coupling and to advance the male member of the first segment into the female member of the coupling, for controlling generation of an impulse energy component superimposed on the primary torque component, and for monitoring the primary and an impulse energy components;

wherein the impulse energy component is generated when a predetermined onset threshold value is reached; and wherein generation of one or both of the primary torque and impulse energy components is discontinued when a predetermined maximum threshold is reached.

26. The apparatus of claim 25 wherein said tong controller further comprises an impulse module for generating the impulse energy component in the form of a secondary torque component.

27. The apparatus of claim 26 wherein the impulse module is operable to reciprocate the drive tong motor to generate the secondary torque component.

28. The apparatus of claim 25 further comprising an impulse energy collar, operable to generate the impulse energy component by imparting mechanical perturbations to the first segment under control of the tong controller.

29. The apparatus of claim 28 wherein the mechanical perturbations are hammer strikes.

30. The apparatus of claim 28 wherein the mechanical perturbations are vibrations.

31. The apparatus of claim 28 wherein said impulse energy collar further comprises:

a means for securing the collar to one of the segments;

a plurality of hammer means;

a cam ring mechanically coupled to a collar motor, the cam ring comprising one or more lobes that pass under the plurality of hammer means as the collar motor turns; and wherein each of the hammer means are operable to be lifted away from the surface of the one of the segments as one of one or more lobes passes underneath, the hammer means operable to return to its original position and to strike the segment after the one of the lobes is clear of the hammer means.

32. An apparatus for making up a tubular connection between a first and second tubular segment, each of the segments comprising an externally threaded male member at one end and an internally threaded female member at the other end, said apparatus comprising:

means for inserting the male member of the first segment into the female member of the second segment;

means for applying a primary torque component to the first segment to engage the external threads of the first segment with the internal threads of the second segment and to advance the male member of the first segment into the female member of the second segment;

means for monitoring the primary torque component applied to the first segment;

means for generating an impulse energy component superimposed on the primary torque component when a predetermined onset threshold has been reached; and means for discontinuing application of one or mere of the primary torque and impulse energy components when a predetermined maximum threshold has been reached.

* * * * *